US005964053A

United States Patent [19]

Liu

[11] Patent Number: 5,964,053

[45] Date of Patent: Oct. 12, 1999

[54] STRUCTURE OF WARNING SIGN

[76] Inventor: Ching-Rong Liu, No. 10, Sung-Chiang N. Road, Chung-Li City, Taiwan

[21] Appl. No.: 09/099,941

[22] Filed: Jun. 19, 1998

[51] Int. Cl.[6] ..... G09F 19/22

[52] U.S. Cl. ..... 40/610; 40/612; 40/606; 404/6; 404/9; 116/63 D

[58] Field of Search ..... 40/606, 610, 612; 404/6, 9; 116/63 P

[56] References Cited

U.S. PATENT DOCUMENTS

| | | | |
|---|---|---|---|
| 3,525,493 | 8/1970 | Chrietzberg et al. | 40/606 X |
| 3,917,232 | 11/1975 | Lindner | 40/6 X |
| 4,298,186 | 11/1981 | Glass | 40/606 X |
| 4,624,210 | 11/1986 | Glass | 404/6 X |
| 4,796,369 | 1/1989 | Hamann | 40/610 X |
| 5,046,885 | 9/1991 | Thurston | 40/610 X |
| 5,382,112 | 1/1995 | Fu | 40/606 X |
| 5,544,614 | 8/1996 | Cushman | 40/610 X |
| 5,621,992 | 4/1997 | Mandell et al. | 40/610 |

*Primary Examiner*—Carl D. Friedman
*Assistant Examiner*—Phi Dieu Tran A
*Attorney, Agent, or Firm*—Bacon & Thomas, PLLC

[57] ABSTRACT

An improved structure of warning sign comprised of two warning plates, two pivot axles and several light reflexible sheets, wherein, the inner sides of two lateral edges on the top end of each warning plate each has a recess, a bevelled edge is provided above each recess, and two lateral engaging plates are provided under the two recesses of each warning plate, one of the lateral engaging plates of each warning plate has inside thereof a protruding engaging spot, and the other lateral engaging plate of the warning plate has inside thereof several arciform dents, each warning plate has on the inner side thereof two engaging plates with a wider spacing and two engaging plates with a narrower sparing, all the engaging plates each has a pivot hole, a square hole is provided between the engaging plates with wider spacings and the engaging plates with narrower spacings.

4 Claims, 8 Drawing Sheets

STRUCTURE OF WARNING SIGN

BACKGROUND OF THE INVENTION

1. Field of the Invention

The present invention is related to an improved structure of warning sign, and especially to an improved structure which is convenient for assembling, folding up and stretching out, and can stably stand and is not easy to fall down, it can well provide a warning function and can guarantee safety of the user thereof; volume of the device of the warning sign is small when it is folded up, so that it is convenient for carrying and storage, and thus is an excellent invention.

2. Description of the Prior Art

A conventional warning sign is used to remind, warn and notice that there is a danger or fault here, to let know not to enter and to make caution, this is an important function; a conventional warning sign is used for a car or maintenance of a road etc., when a car is driven on a road and is out of work, warning signs must be placed and stand in the front and at the rear of the car, in order to notice the drivers of other cars passing by to drive cautiously; or when a road is under maintenance and repair, warning signs are placed in the field of working to remind the people and cars passing by to be careful and to watch out, the warning signs provide warning function against danger; particularly in the dark weather, on the cloudy rainy day or in the night, warning signs are more important in warning danger, to avoid collision or falling down etc.

Warning signs are widely used, the warning signs (marked with A) used presently (as shown in FIG. 1) are assemblable, i.e., for each warning sign, a set of light reflexible plates B are arranged in a triangle shape, a supporting rod C is provided at the rear of the warning sign A, so that the warning sign A can stand, however, the warning sign A is only supported by the supporting rod C, it is structurally quite unstable, and is subjected to blowing down by wind or shaking down by a strong vibration, and the function of warning loses; for example, when a car is out of work and pulled over, warning signs A are placed and stand in the front and at the rear of the car in order to notice the drivers of other cars passing by to drive cautiously, however, the warning signs A are unstable and fall down, and is unable to warn the cars passing by, and more serious hurt may be incurred; or the warning signs A fall down in maintenance and repair of a road such that the people and cars passing by inadvertently fall or collide; and even more, when in the night, or in a cloudy or rainy dark weather, warning signs A are unable to be stably erected, the damage that may occur must be much more serious; further, area of the light reflexible plates B is unconcentrated and too small to effectively give warning, the effective visibility in this situation is very short. Warning signs A are surely necessary, but they are much deficient and need improvement pressingly.

And more, another warning sign stand D has been used at the present time (as shown in FIG. 2), it is comprised of a front warning plate E and a rear warning plate F pivotally connected at two top pivotal connections H and is added with a handle G, while the front warning plate E and the rear warning plate F are structurally different form each other, they must be manufactured separately, the cost of the moulds for them is very high; and when the front warning plate E and the rear warning plate F are pivotally connected with each other, the two top pivotal connections H are pivotal rather than fixed, they must be pulled away to be able of standing, however, the warning sign stand D does not have a supporting device, the front warning plate E and the rear warning plate F thereof are subjected to getting closed so long they are slightly knocked or blown by wind, thus the warning sign stand D falls down and loses its function of warning.

SUMMARY OF THE INVENTION

In view that warning signs are very important warning device for giving a warning to avoid accident, while by virtue that the warning signs used presently are structurally undesirable, and is subjected to falling down to lose its function of warning, the inventor provides the present invention based on his professional experience of years in manufacturing, designing and selling practising and after continuous study and improving, repeated experiments and tests, by assembling of two warning plates, a warning sign stand is completed, the feet of the stand can be opened for standing stably against collapsing, the function of warning thus can be well provided.

The primary object of the present invention is to assemble a warning sign stand by connecting two warning plates and having a pivot axle extended through a plurality of pivot holes, the warning sign stand can be opened and closed, and when the warning sign stand is opened, the center of gravity thereof locates between the two warning plates to render it to stand stably.

The secondary object of the present invention is to improve the warning function of the two warning plates by providing larger areas for the two warning plates of the warning sign stand, and having more or larger light reflexible material on the warning plates to increase light reflecting areas.

Another object of the present invention is to provide two structurally identical warning plates, only one kind of warning plate is required to be manufactured, and two warning plates are used to be connected with each other, there is no distiction between the front one and the rear one of the warning plates, therefore, only one mould is needed, and cost of production is reduced, and speed of manufacturing can be increased.

Another object of the present invention is to provide a warning sign stand which is uneasy to be tilted nor to fall by blowing down by wind or by collision.

A further object of the present invention is to provide a warning sign stand combined by the two warning plates, the warning sign stand is flat when is folded up, and is convenient for carrying and storage, the space occupied thereby is small.

The present invention will be apparent in its structure, characteristics and way of using after reading the detailed description of the preferred embodiments thereof in reference to the accompanying drawings.

DETAILED DESCRIPTION OF THE PREFERRED EMBODIMENT

Figure 1:
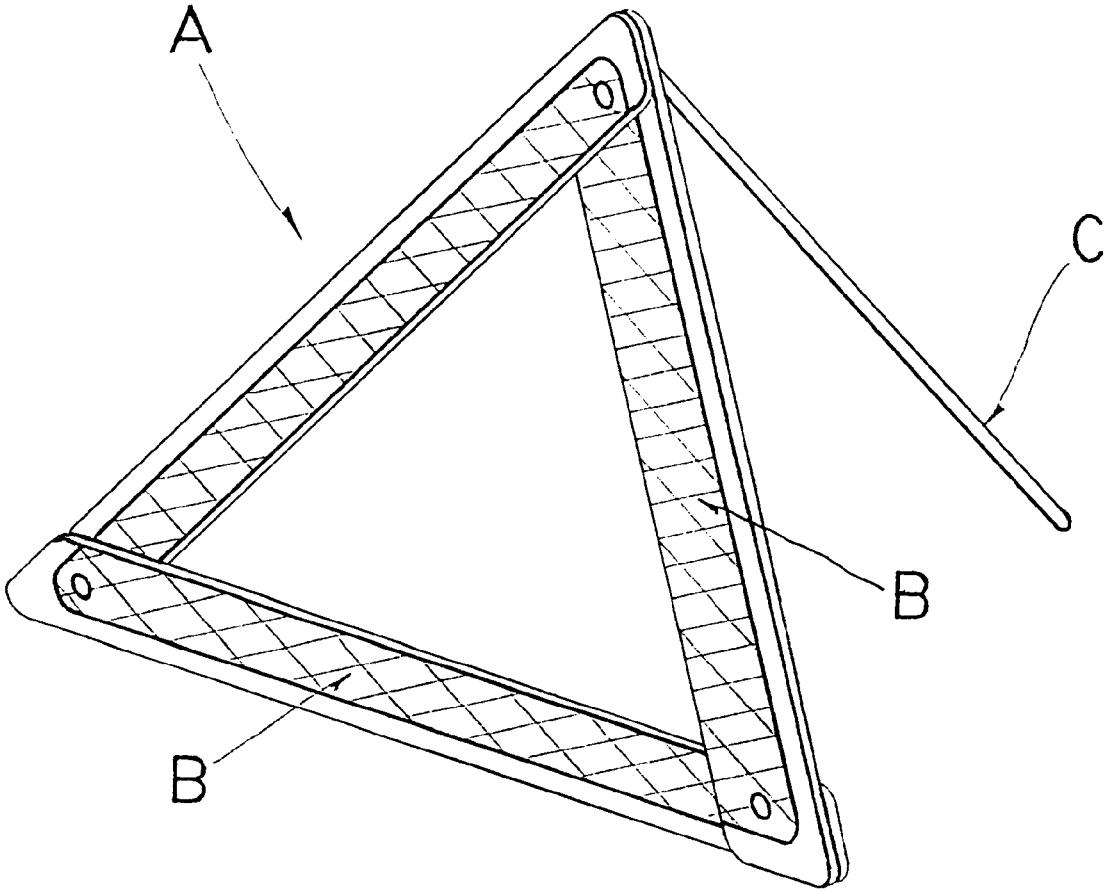
FIG. 1 is a perspective view showing the structure of a conventional warning sign stand.
Figure 2:
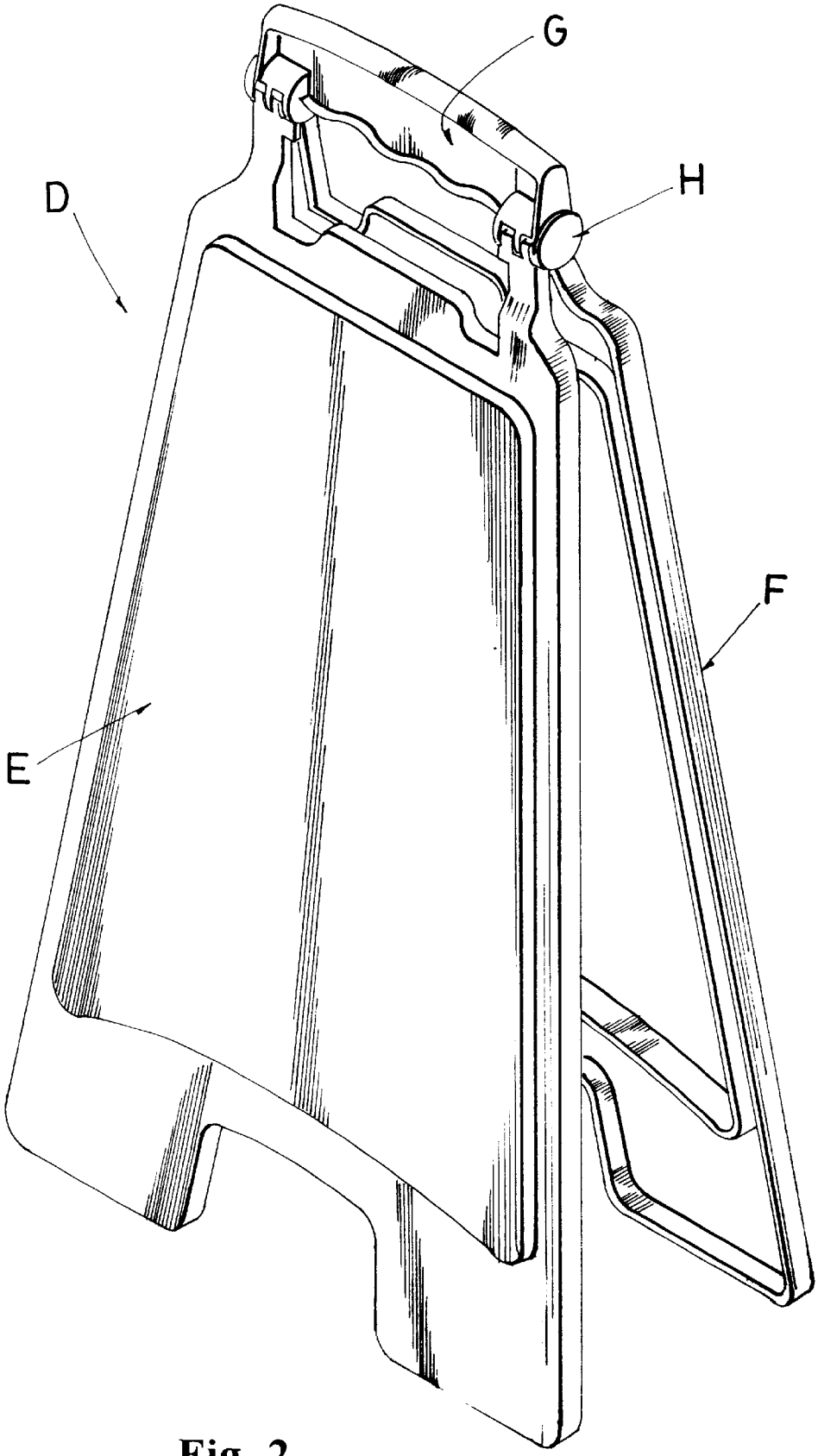
FIG. 2 is a perspective view showing the structure of another conventional warning sign stand.
Figure 3:
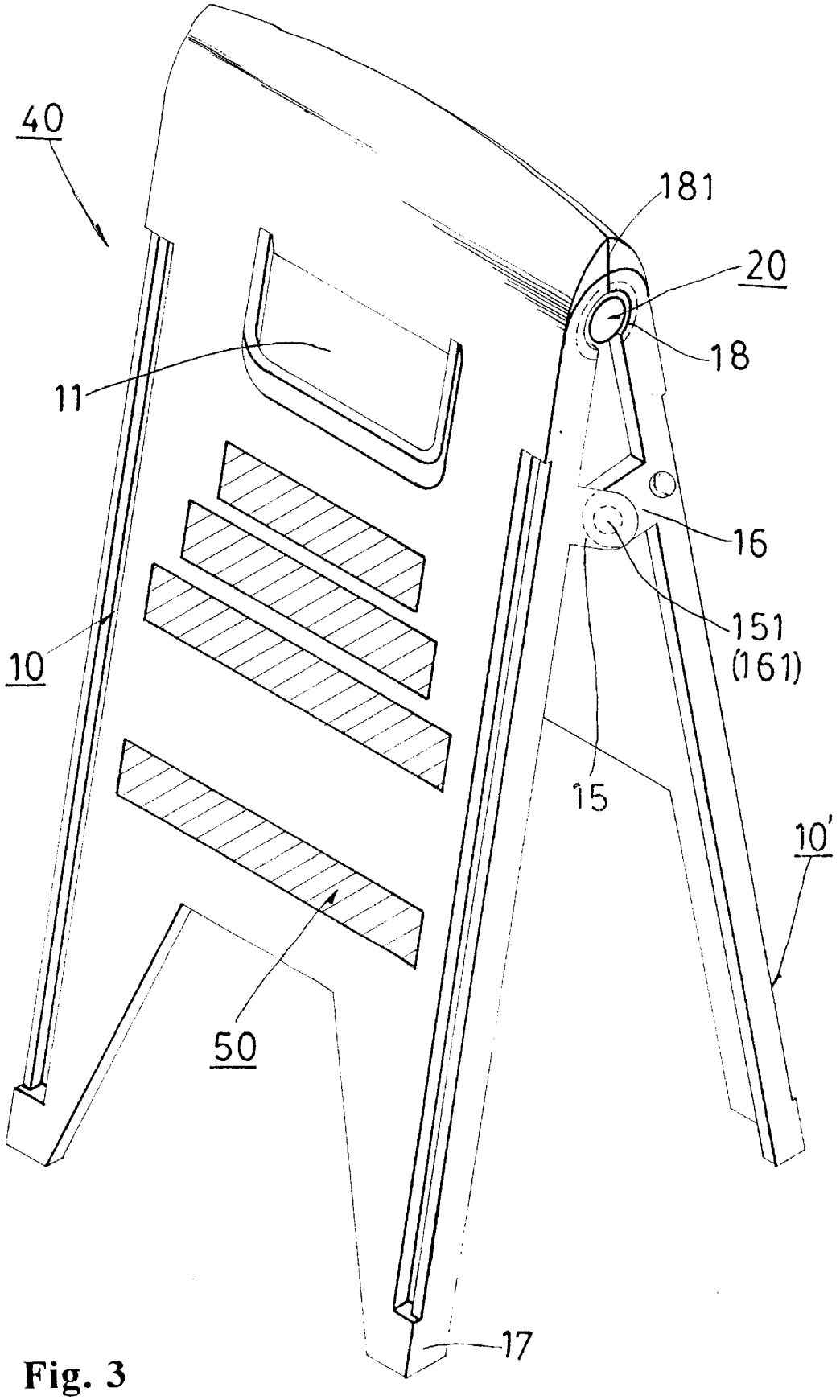
FIG. 3 is a perspective view showing the structure of the present invention.
Figure 4:
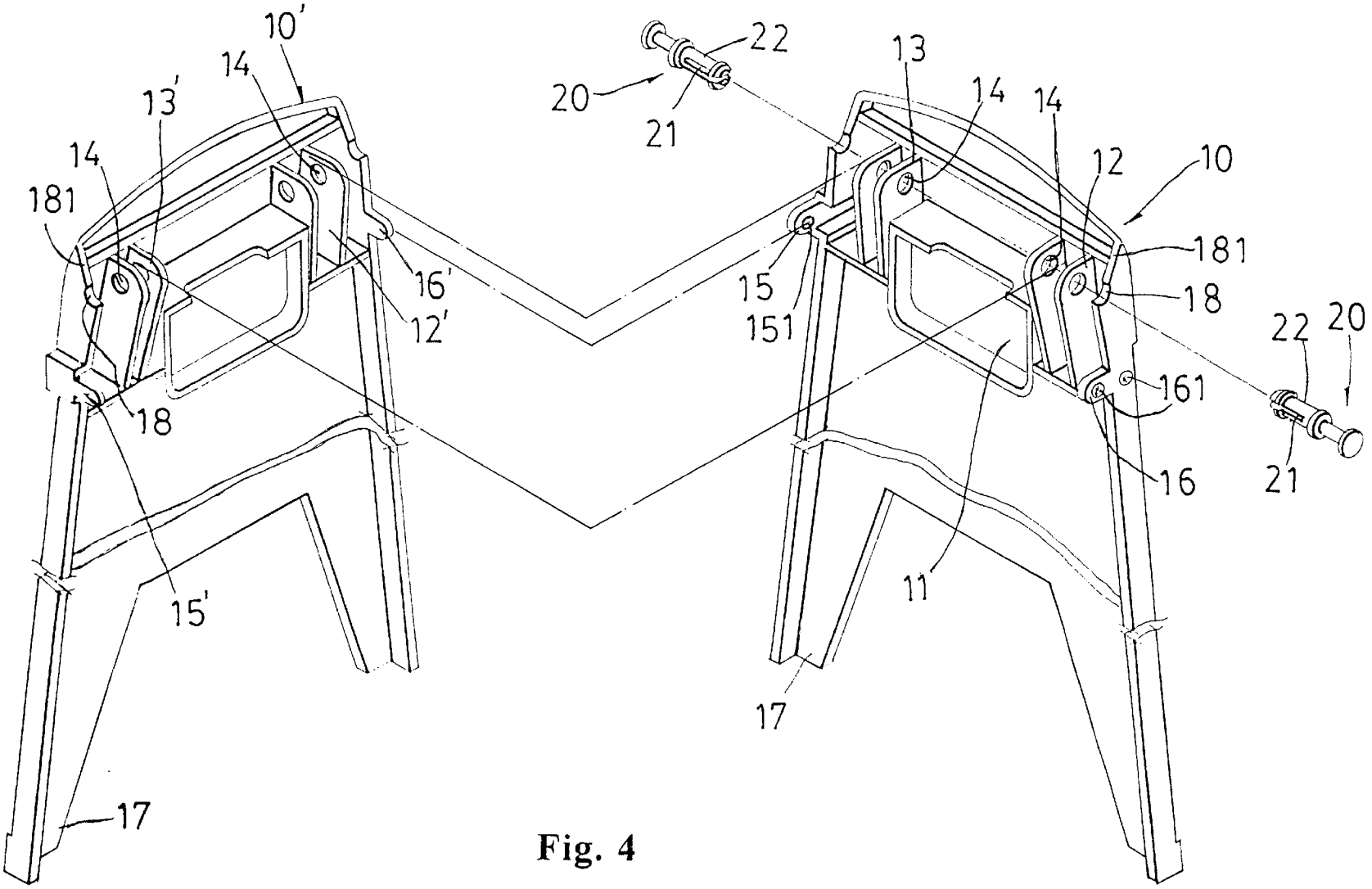
FIG. 4 is an analytic perspective view showing the structure of the present invention.

Referring to FIG. 3 and 4, a warning sign stand 40 of the present invention is comprised of two warning plates 10, two pivot axles 20 and a plurality of light reflexible sheets 50, wherein:

The two warning plates 10, 10' each is in the form of a plain plate, the inner sides of two lateral edges on the top end of each warning plate 10 (10') are provided each with a recess 18, a bevelled edge 181 is provided above each recess 18, and two lateral engaging plates 15, 16 (15', 16') are provided under the two recesses 18 of each warning plate 10 (10'), the lateral engaging plate 15 (15') is provided inside thereof with a protruding engaging spot 151 (151') and the lateral engaging plate 16 (16') is provided inside thereof with an arciform dent 161 (161'), the warning plate 10 (10') is provided on the inner side thereof with a pair of engaging plates 12 (12') with a wider spacing and a pair of engaging plates 13 (13') with a narrower spacing, the engaging plates 13 (13') with a narrower spacing and the engaging plates 12 (12') with a wider spacing are each provided with a pivot hole 14, a square window like hole 11 is provided between the engaging plates 12 (12') and the engaging plates 13 (13'), the lower portion of each warning plate 10 (10') is formed two legs 17.

The pivot axles 20 each is in the shape of a round rod and each is provided on the front end thereof with a recessed axle portion 22 having a connection hole 21.

The remainings are the reflexible sheets 50.

Figure 5:
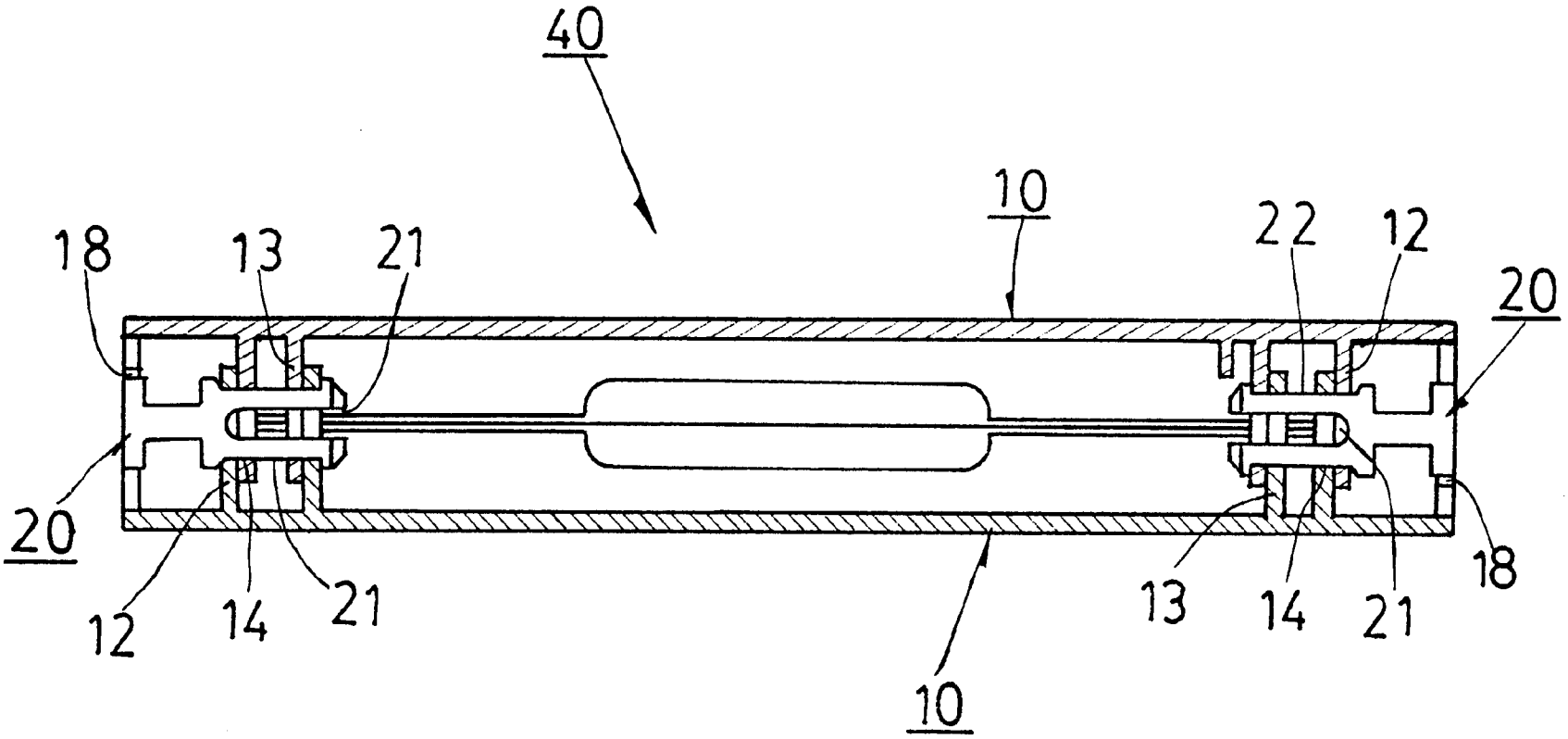
FIG. 5 is a schematic sectional view showing pivotal connection of the warning plates of the present invention.
Figure 6:
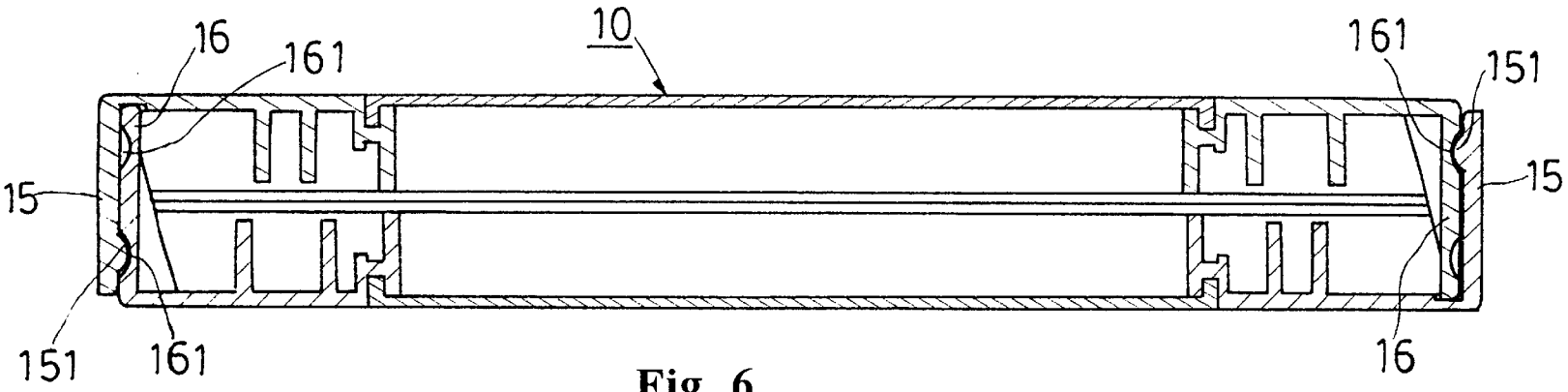
FIG. 6 is a schematic sectional view showing mutual engagement of the warning plates of the present invention.
Figure 6A:
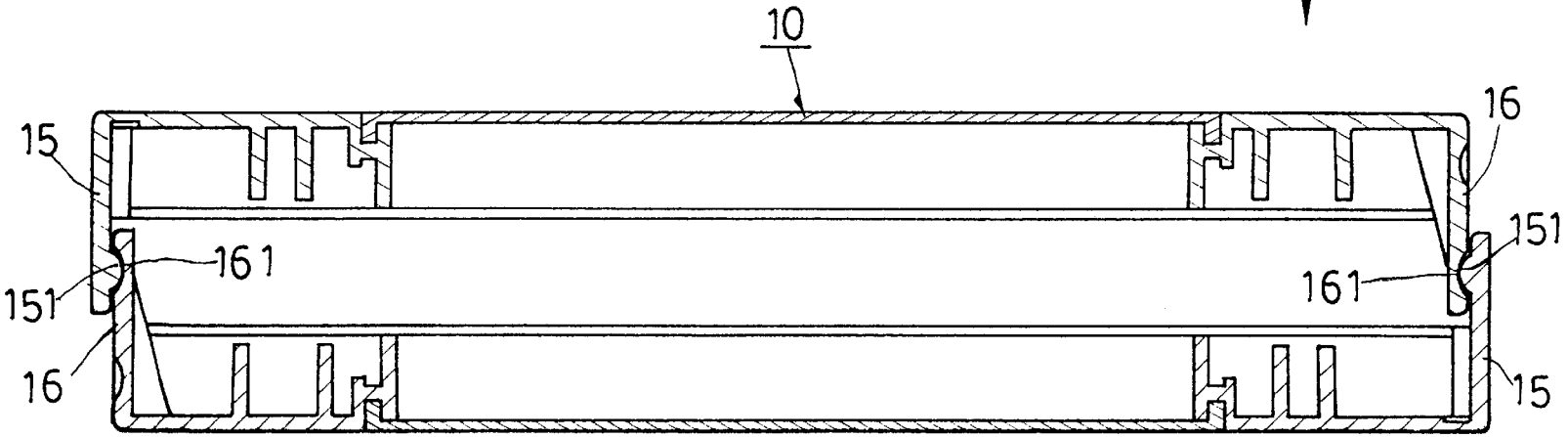

By providing the above mentioned members, in assembling, the two warning plates 10, 10' are connected to each other, the engaging plates 13 (13') with a narrower spacing on the inner side of the warning plate 10 (10') are engaged respectively with the engaging plates 12' (12) with a wider spacing, the two lateral engaging plates 15, 15' of the two warning plates 10, 10' are abutted against the lateral engaging plate 16', 16 respectively, the protruding engaging spots 151, 151' on the two lateral engaging plates 15, 15' are engaged in the arciform dents 161', 161 of the lateral engaging plates 16', 16 respectively (as shown in FIG. 6), to increase stability of the warning plates 10, 10'; then the pivot axles 20 are extended respectively through the pivot holes 14 of the engaging plates 12, 12' and the engaging plates 13, 13'on the inner side of the two warning plates 10, 10', so that the recessed axle portions 22 of the pivot axles 20 are engaged in the pivot holes 14 (as shown in FIG. 5), and the warning plates 10, 10' are connected to form the warning sign stand 40 which is capable of opening and closing conveniently (as shown in FIG. 3), when the two legs 17 on the lower portion of the warning plates 10, 10' are separated to stand, the center of gravity of the warning sign stand 40 is located between the two warning plates 10, 10', and the warning sign stand 40 can stand stably and is not subjected to falling; the light reflexible sheets 50 or a whole piece of light reflexible sheet 50 can be provided on the exterior surfaces of the warning plates 10, 10', the reflexible sheets 50 can be regularly or irregularly arranged to increase the total area and thus the effect of warning of the light reflexible surfaces of the warning sign stand 40.

Figure 7:
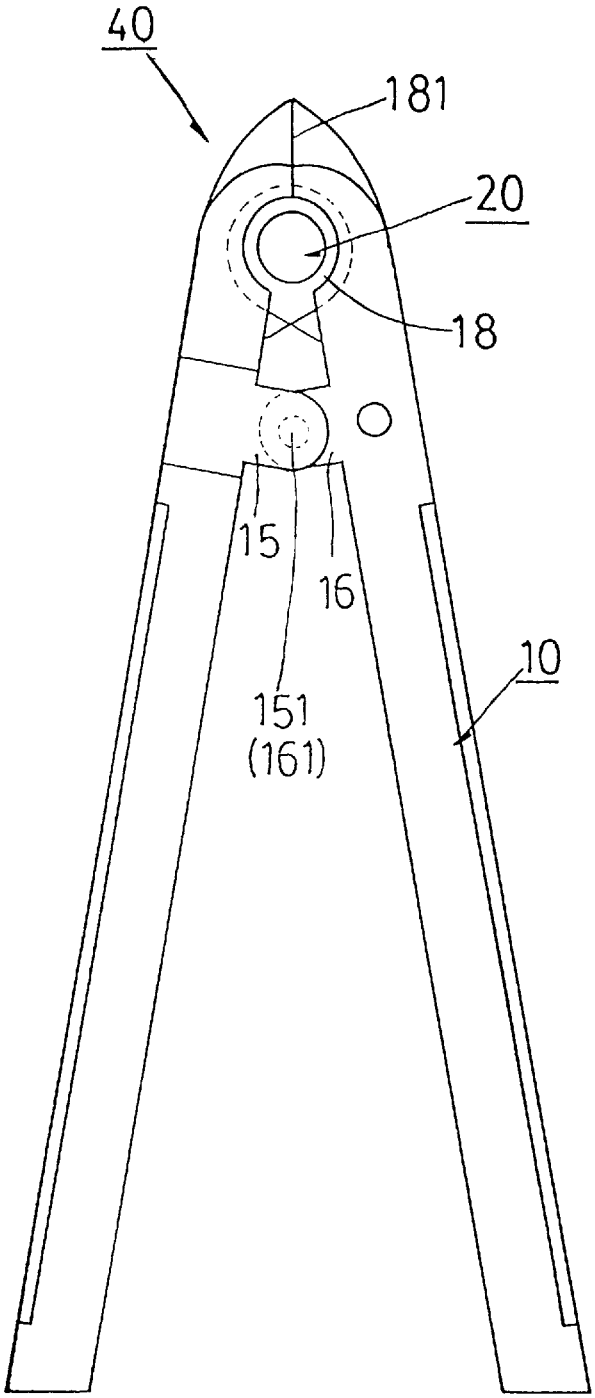
FIG. 7 is a sectional view showing the structure of the present invention when is opened.
Figure 8:
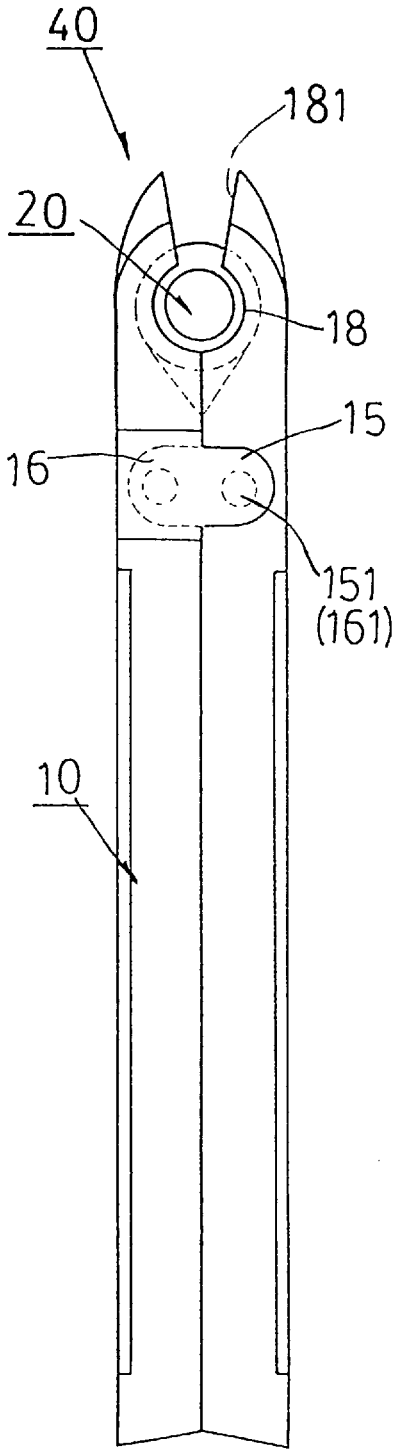
FIG. 8 is a sectional view showing the structure of the present invention when is closed.

Referring to FIG. 7 and 8, when the warning plates 10, 10' of the warning sign stand 40 are opened, the protruding engaging spots 151, 151' on the two lateral engaging plates 15, 15' of the warning plates 10, 10' are engaged in the outer arciform dents 161', 161 of the lateral engaging plates 16', 16 respectively (as shown in FIG. 6), and when the warning plates 10, 10' are closed, the protruding engaging spots 151, 151' on the two lateral engaging plates 15, 15' are engaged in the inner arciform dents 161', 161 of the lateral engaging plates 16', 16 respectively, by engagement of the the protruding engaging spots 151, 151' and the outer arciform dents 161', 161 on the two lateral engaging plates 15, 15' and the lateral engaging plates 16', 16, stability and firmness of the warning sign stand 40 can be increased, the warning sign stand 40 can be grasped by a hand by means of the square window like hole 11 of the two warning plates 10, 10' (as shown in FIG. 3), so that convenience of the warning sign stand 40 can be increased.

Figure 9:
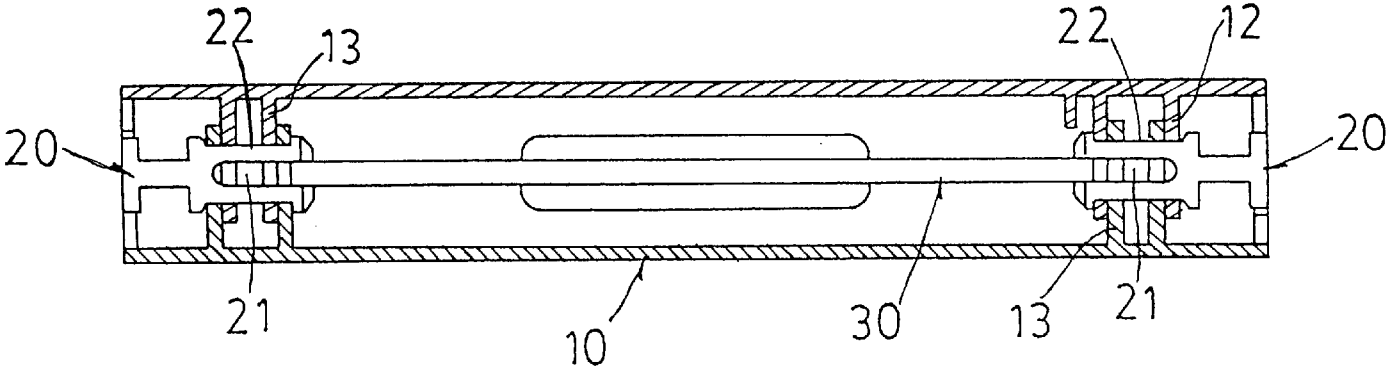
FIG. 9 is a schematic sectional view showing another way of mutual engagement of the warning plates of the present invention.
Figure 9A:
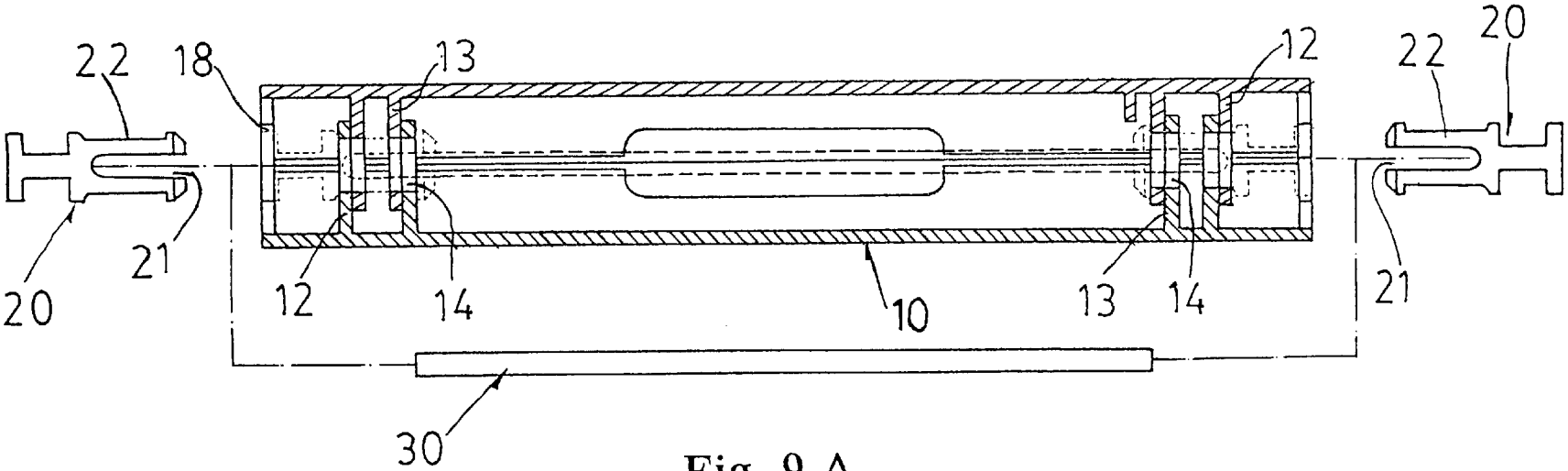

Referring to FIG. 9, the pivot axles 20 of the present invention are extended respectively through the pivot holes 14 of the engaging plates 12, 12' and the engaging plates 13, 13' on the two warning plates 10, 10', an axle rod 30 is extended through the connection holes 21 of the pivot axles 20, so that the pivot axles 20 are pivotably connected and allow the warning plates 10, 10' to open and close more conveniently.

In conclusion, the warning sign stand 40 is assembled by connecting of the warning plates 10, 10', when it is opened, the center of gravity of the warning sign stand 40 is located between the two warning plates 10, 10', and the warning sign stand 40 can stand stably, this can increase the total area and thus the effect of warning of the light reflexible surfaces of the warning sign stand 40.

Having thus described my invention, what I claim as new and desire to be secured by Letters Patent of the United States are:

1. An improved structure of warning sign comprised of two warning plates, two pivot axles and a plurality of light reflexible sheets, wherein:

said two warning plates each is in the form of a plain plate, the inner sides of two lateral edges on a top end of each said warning plate are provided each with a recess, a bevelled edge is provided above each said recess, and two lateral engaging platens are provided under said two recesses of each said warning plate, one of said lateral engaging plates of each said warning plate is provided inside thereof with a protruding engaging spot and the other lateral engaging plate of said warning plate is provided inside thereof with a plurality of arciform dents, each of said warning plates is provided on the inner side thereof with a pair of engaging plates with a wider spacing and a pair of engaging platens with a narrower spacing, all said engaging plates are provided each with a pivot hole, a square window like hole is provided between said engaging plates with wider spacings and said engaging plates with narrower spacings, said lower portion of each said warning plate is formed two legs;

said pivot axles each is in the shape of a round rod and is provided on a front end thereof with a recessed axle portion having a connection hole;

the remainings are said light reflexible sheets;

by providing the above parts in assembling, said two warning plates are connected to each other, said engaging plates with narrower spacings on said inner sides of said warning plates are engaged respectively with said engaging plates with wider spacings, said lateral engaging plates of said warning plates are mutually abutted against their corresponding ones of said lateral engaging plates, said protruding engaging spots on said lateral engaging plates on one of said warning plates are engaged in said arciform dents of said lateral engaging plates on the other of said warning plates to increase stability of said warning plates, then said pivot axles are extended respectively through said pivot holes of all said engaging plates on the inner sides of said two warning plates, so that said recessed axle portions of said pivot axles are engaged in said pivot holes and said warning plates are connected to form said warning sign stand which is capable of opening and closing conveniently, said light reflexible sheets are provided on the exterior surfaces of said warning plates to increase the total area and thus an effect of warning of said light reflexible surfaces of said warning sign stand.

2. An improved structure of warning sign as in claim 1, wherein, when said warning sign stand is opened, the center of gravity of said warning sign stand is located between said two warning plates, and said warning sign stand thus stands stably and is not subjected to falling.

3. An improved structure of warning sign as in claim 1, wherein, opening or closing of said two warning plates makes said protruding engaging spots on said lateral engaging plates be engaged in said arciform dents on the opposite corresponding one of said lateral engaging plates to increase stability of said warning plates.

4. An improved structure of warning sign as in claim 1, wherein, said two pivot axles are extended respectively through said pivot holes of all said engaging plates on said two warning plates, an axle rod is extended through said connection holes of said pivot axles, so that said pivot axles are pivotably connected by said axle rod and allow said warning plates to open and close more conveniently.

* * * * *